US010121583B2

(12) United States Patent
Chang et al.

(10) Patent No.: US 10,121,583 B2
(45) Date of Patent: Nov. 6, 2018

(54) COIL STRUCTURE AND ELECTROMAGNETIC COMPONENT USING THE SAME

(71) Applicant: CYNTEC CO., LTD., Hsinchu (TW)

(72) Inventors: Wei-Chien Chang, Hsinchu County (TW); Chia-Chi Wu, New Taipei (TW); Lang-Yi Chiang, Keelung (TW); Tsung-Chan Wu, Hsinchu (TW); Jih-Hsu Yeh, Taipei (TW)

(73) Assignee: CYNTEC CO., LTD, Hsinchu (TW)

( * ) Notice: Subject to any disclaimer, the term of this patent is extended or adjusted under 35 U.S.C. 154(b) by 71 days.

(21) Appl. No.: 14/697,645

(22) Filed: Apr. 28, 2015

(65) Prior Publication Data

US 2015/0243430 A1 Aug. 27, 2015

Related U.S. Application Data

(63) Continuation of application No. 13/868,995, filed on Apr. 23, 2013.

(60) Provisional application No. 61/637,277, filed on Apr. 24, 2012.

(51) Int. Cl.

| | |
|---|---|
| ***H01F 5/00*** | (2006.01) |
| ***H01F 27/28*** | (2006.01) |
| ***H01F 5/02*** | (2006.01) |
| ***H01F 27/29*** | (2006.01) |
| ***H01F 41/04*** | (2006.01) |
| *H01F 17/04* | (2006.01) |

(52) U.S. Cl.

CPC ..... *H01F 27/2804* (2013.01); *H01F 5/003* (2013.01); *H01F 5/02* (2013.01); *H01F 27/292* (2013.01); *H01F 41/04* (2013.01); *H01F 2017/048* (2013.01); *H01F 2027/2809* (2013.01); *Y10T 29/49002* (2015.01); *Y10T 29/4902* (2015.01); *Y10T 29/49071* (2015.01); *Y10T 29/49073* (2015.01); *Y10T 29/49075* (2015.01)

(58) Field of Classification Search

CPC ..... H01F 27/2804; H01F 2027/2809; H01F 41/041; H01F 17/0013; H01L 28/10

USPC ..... 336/200

See application file for complete search history.

(56) References Cited

U.S. PATENT DOCUMENTS

| | | | | |
|---|---|---|---|---|
| 5,426,404 | A * | 6/1995 | Kommrusch | H01P 3/088 333/128 |
| 6,608,545 | B2 * | 8/2003 | Fricker | H01F 27/2804 336/200 |
| 6,714,112 | B2 * | 3/2004 | Beng | H01F 17/0006 336/200 |
| 6,812,819 | B2 * | 11/2004 | Le Grand de Mercey | H01F 17/0006 257/E27.046 |
| 6,903,646 | B2 * | 6/2005 | Takaike | H01F 17/0013 257/E27.046 |

(Continued)

*Primary Examiner* — Alexander Talpalatski
*Assistant Examiner* — Joselito Baisa
(74) *Attorney, Agent, or Firm* — Min-Lee Teng; Litron Patent & Trademark Office

(57) ABSTRACT

An electromagnetic component including a multi-layer, spiral coil structure embedded in a molded body is disclosed. Each layer of the coil structure makes approximately one and a quarter turns of a winding. Each layer of the coil structure has a loose middle segment, two slim end segments overlapping each other with a spacing therebetween, and tapered neck segments respectively connecting the loose middle segment with the two slim end segments.

18 Claims, 7 Drawing Sheets

(56) References Cited

U.S. PATENT DOCUMENTS 6,922,128 B2 * 7/2005 Vilander ..... H01F 17/0006 257/531
7,071,685 B2 * 7/2006 Saltsov ..... G01D 5/204 194/320
7,071,806 B2 * 7/2006 Masu ..... H01F 17/0006 29/602.1
7,382,222 B1 * 6/2008 Manetakis ..... H01F 17/0006 336/200
7,486,168 B2 * 2/2009 Kim ..... H01F 17/0013 336/200
7,705,704 B2 * 4/2010 Lee ..... H01F 17/0006 336/147
7,986,210 B2 * 7/2011 Gianesello ..... H01F 17/0013 336/200
8,279,036 B2 * 10/2012 Banno ..... H01F 27/292 336/200
2002/0067235 A1 * 6/2002 Ueda ..... H01F 17/0006 336/200
2004/0056749 A1 * 3/2004 Kahlmann ..... H01L 27/08 336/200
2005/0052272 A1 * 3/2005 Tiebout ..... H01F 17/0006 336/232
2006/0284718 A1 * 12/2006 Baumgartner ..... H01F 17/0006 336/223
2009/0045903 A1 * 2/2009 Lin ..... H01F 17/0006 336/200
2011/0007439 A1 * 1/2011 Asakawa ..... H01F 17/0006 361/56
2011/0109417 A1 * 5/2011 Bertram ..... H01F 19/04 336/200
2013/0100555 A1 * 4/2013 Sasaki ..... G11B 5/1278 360/244
2013/0222101 A1 * 8/2013 Ito ..... H01F 17/04 336/83

* cited by examiner

COIL STRUCTURE AND ELECTROMAGNETIC COMPONENT USING THE SAME

CROSS REFERENCE TO RELATED APPLICATIONS

This application is a continuation of U.S. application Ser. No. 13/868,995, filed Apr. 23, 2013, which claims priority from U.S. provisional application No. 61/637,277, filed Apr. 24, 2012.

BACKGROUND OF THE INVENTION

1. Field of the Invention

The present invention relates to a coil structure for electromagnetic components and, more particularly, to a coil structure constructed.

2. Description of the Prior Art

As known in the art, electromagnetic components such as inductors or choke coils have typically been constructed by winding conductor wires about a cylindrical core. For example, insulated copper wires may be wrapped around the core. Structures of such electromagnetic components are usually designed to meet the surface mounting technology (SMT) or surface mounting device (SMD).

The rapid advance toward electronic components having smaller size and higher performance in recent years is accompanied by strong demand for coil elements having smaller size and higher performance in terms of saturation current ($I_{sat}$) and DC resistance (DCR). However, the size of the prior art electromagnetic component is difficult to shrink further.

What is needed, therefore, is an improved electromagnetic component having better performance such as larger saturation current, reduced DCR and better efficiency, while the size of the electromagnetic component can be miniaturized.

SUMMARY OF THE INVENTION

It is one object of the invention to provide an improved coil structure for electromagnetic components, which can be formed with a smaller size and high yield.

According to one embodiment, an electromagnetic component includes a multi-layer coil structure embedded in a molded body is disclosed. Each layer of the coil structure comprises a loose middle segment, two slim end segments overlapping each other with a spacing therebetween, and tapered neck segments respectively connecting the loose middle segment with the two slim end segments.

According to one aspect of the invention, an electromagnetic component includes a substrate; a multi-layer coil structure on the substrate; and a molded body encapsulating the substrate and the coil structure. The molded body fills into a central opening of the substrate to thereby constitute a pillar surrounded by the coil structure. A coil winding of the coil structure is spirally wound with multiple turns around the pillar. The coil winding of the coil structure comprises multiple segments including two distal, slim end segments, intermediate segments with a uniform width, and tapered segments. At least one of the tapered segments has an outline that conforms to outline of an inner terminal of the coil winding of the coil structure.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

It should be noted that all the figures are diagrammatic. Relative dimensions and proportions of parts of the drawings are exaggerated or reduced in size, for the sake of clarity and convenience. The same reference signs are generally used to refer to corresponding or similar features in modified and different embodiments.

DETAILED DESCRIPTION

In the following description, numerous specific details are given to provide a thorough understanding of the invention. It will, however, be apparent to one skilled in the art that the invention may be practiced without these specific details. Furthermore, some well-known system configurations and process steps are not disclosed in detail, as these should be well-known to those skilled in the art. Therefore, the scope of the invention is not limited by the flowing embodiments and examples.

Figure 1:
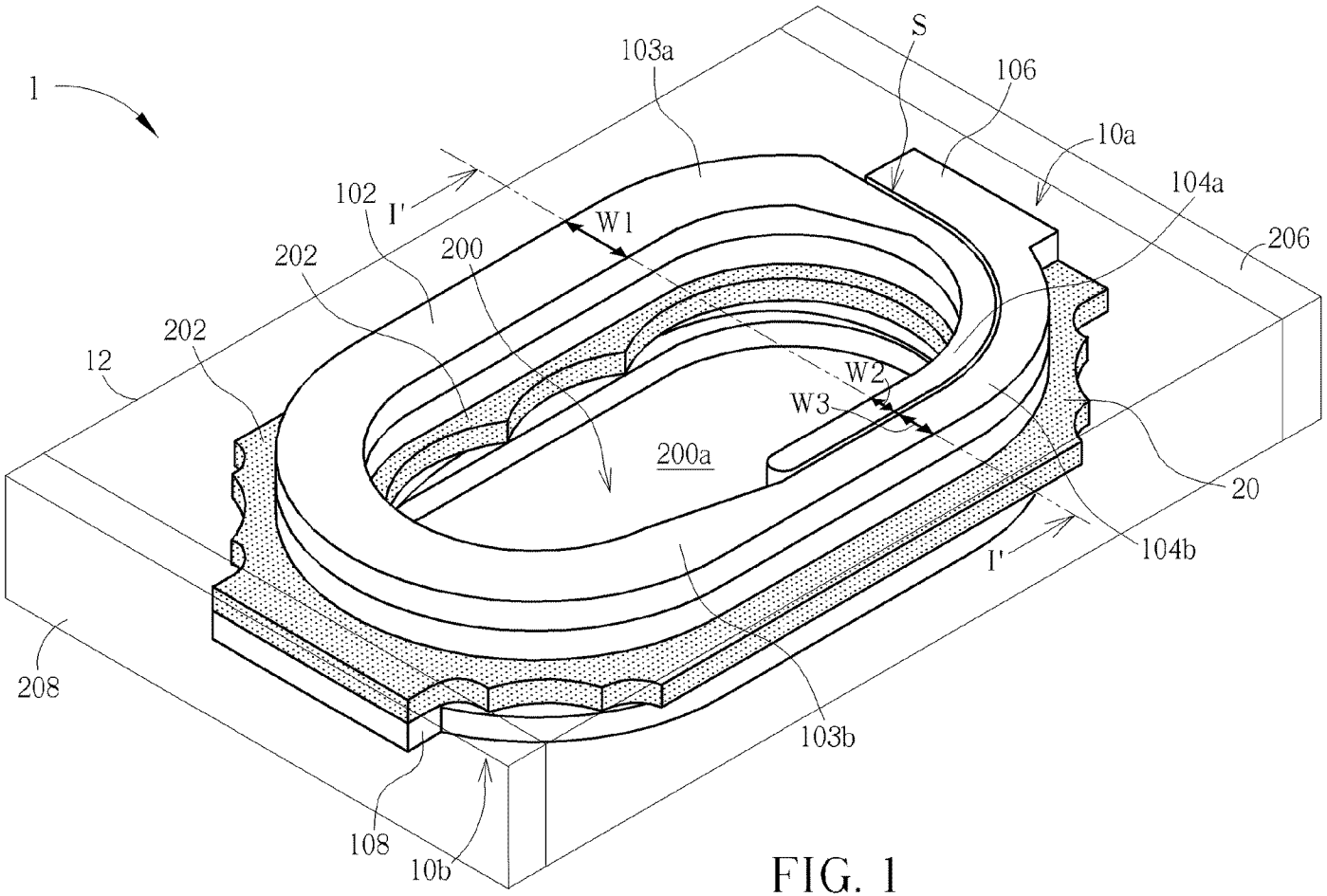
FIG. 1 is a schematic, perspective view showing an electromagnetic component in accordance with one embodiment of this invention.

FIG. 1 is a schematic, perspective view showing an exemplary coil structure of an electromagnetic component in accordance with one embodiment of this invention. As shown in FIG. 1, the electromagnetic component 1, such as an inductor or choke coil, comprises a coil structure 10*a* situated on one side of a substrate 20. The substrate 20 may be an insulating substrate, but not limited thereto. The coil structure 10*a* may have a single-layered or multi-layered conductor film stack structure with intervening insulating layers. On the opposite side of the substrate 20, a coil structure 10*b*, which may be a multi-layer conductor film stack similar to the coil structure 10*a*, may be provided.

The substrate 20 may have annular shape that is similar to the annular shape of the coil structure 10*a* or 10*b* that is disposed on either side of the substrate 20. A central opening 200 may be defined together by the sidewalls of the substrate 20 and the sidewalls of the coil structures 10*a* and 10*b*. The central opening 200 may be formed by using laser or mechanical drill methods after the formation of the coil structures 10*a* and 10*b*. According to the embodiment, the substrate 20 may have an irregular side profile, for example, saw-toothed shape, around the perimeter of the central opening 200. It preferable to form less serration 202 around the perimeter of the central opening 200 so that more magnetic material may be filled into the central opening 200 and the performance of the electromagnetic component 1 can be improved.

Figure 1A:
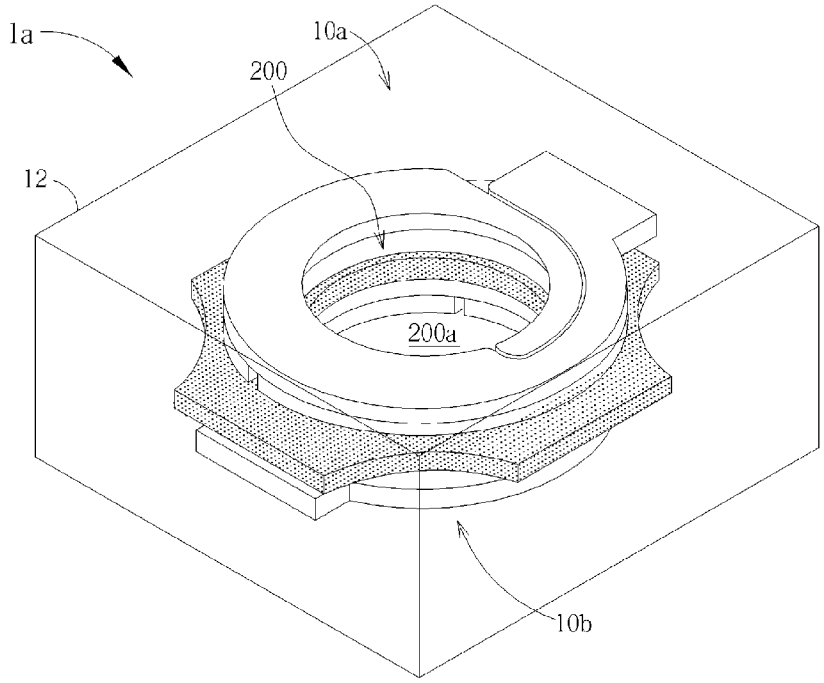
FIG. 1A shows an electromagnetic component with a cubic shaped molded body.

The electromagnetic component 1 may further comprise a molded body 12 formed in a shape of, for example, rectangular parallelepiped, for encapsulating the coil structures 10*a*, 10*b* and the substrate 20. However, it is to be understood that other shapes or profiles of the molded body 12 are also possible. For example, FIG. 1A shows an electromagnetic component 1*a* with a cubic shaped molded body 12. In this case, the coil structure 10*a* or 10*b* may have a circular shape when viewed from the above.

The molded body 12 may comprise thermosetting resins and metallic powder such as ferrite powder, ion powders, or any suitable magnetic materials known in the art. The molded body 12 also fills into the central opening 200 to form a central pillar 200*a* that is surrounded by the coil structures 10*a* and 10*b*, wherein the central opening 200 and the central pillar 200*a* may have various shapes or outlines, for example, circular, oval, polygonal or elliptic shapes when views from the above.

According to the embodiment, the electromagnetic component 1 may be manufactured as a surface mount device SMD, which is a device that can be mounted directly to a surface of a circuit board or leadframe. For example, the electromagnetic component 1 may comprise two SMD electrodes 206 and 208 electrically connected to two terminals 106 and 108 of the coil structure 10*a* or 10*b*, respectively. For example, the SMD electrodes 206 and 208 may comprise soldered or plated metals.

According to the embodiment, the coil structure 10*a* or 10*b* may be a multi-layer winding, wherein each layer of the coil structure makes at least one turn of a winding. For example, each layer of the winding makes approximately one and a quarter turns to form a spiral pattern when viewed from above. For example, as can be seen in FIG. 1, each layer of the coil structure 10*a* may include a loose middle segment 102 having a wider, uniform line width w1 of about 210 micrometers, two slim end segments (or tails) 104*a* and 104*b* curled up to overlap each other with a spacing S of about 5-30 micrometers, preferably 5-10 micrometers therebetween, and tapered neck segments 103*a* and 103*b* respectively connecting the loose middle segment 102 with the two slim end segments 104*a* and 104*b*.

Figure 1B:
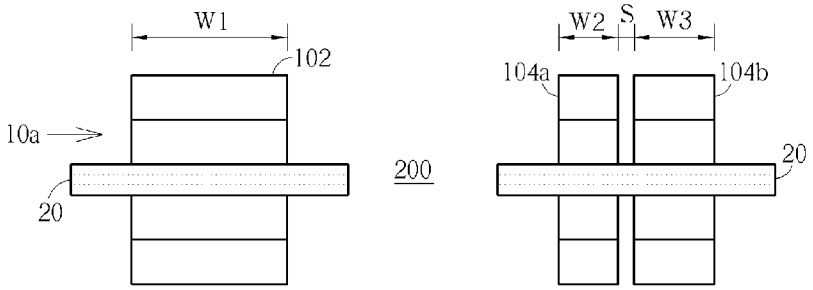
FIG. 1B is a schematic cross-sectional view taken along line I-I' of FIG. 1.

According to the exemplary embodiment, the two slim end segments 104*a* and 104*b* may have a narrower line width w2 and w3 both less than or equal to 100 micrometers, for example. The line width w2 may not equal to the line width w3. It is understood that the line widths w1, w2 and w3 are adjustable depending upon the design requirements. FIG. 1B is a schematic cross-sectional view taken along line I-I' of FIG. 1. The intervening insulating layers are not expressly shown. As shown in FIG. 1B, the line width w1 may substantially equal to the combination of the line widths w2, w3 and the spacing S between the overlapping end segments 104*a* and 104*b*.

It is noteworthy that the loose middle segment 102, the tapered neck segments 103*a* and 103*b*, and the two slim end segments 104*a* and 104*b* are all in the same horizontal plane or level, and may be fabricated concurrently in the same process step. When viewed from above, the layer of the coil structure 10*a* or 10*b* may have an annular, oval-shaped stripe pattern. The layers of the coil structure 10*a* or 10*b* may be insulated from one another using an insulating film (not explicitly shown) interposed therebetween. The adjacent layers of the coil structure 10*a* or 10*b* may be electrically connected together in series using a via or plug formed each insulating film. By using such space efficient configuration, the performance of the electromagnetic component 1 can be improved and/or the size of the electromagnetic component 1 can be further reduced.

According to the embodiment of this invention, the coil structure 10*a* or 10*b* may be fabricated using the following manufacturing techniques including but not limited to etching, plating, etc. It is to be understood that the process steps are only for illustration purposes, and other methods and manufacturing techniques, for example, printing, may be used in other embodiments.

Figure 2:
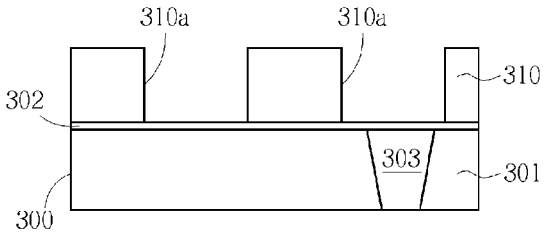
FIGS. 2-10 are schematic, cross-sectional diagrams showing a method for fabricating a coil structure in accordance with one embodiment of this invention.

FIGS. 2-10 are schematic, cross-sectional diagrams showing an exemplary method for fabricating a coil structure in accordance with one embodiment of this invention. As shown in FIG. 2, first, a substrate 300 is provided. The substrate 300 may have thereon at least one copper layer 302 laminated on an insulating substrate 301 made of, for example, dielectric or epoxy glass, and at least one via 303 extending through the thickness of the substrate 300. The via 303 may be a plated through hole that may be fabricated using conventional mechanical or laser drill processes and plating methods. For the sake of simplicity, only the layers fabricated on one side of the substrate 300 are demonstrated. It is to be understood that the same stack structure may be fabricated on the other side of the substrate 300 using similar process steps as disclosed in this embodiment.

A patterned photoresist layer 310 is then provided on the surface of the substrate 300. The patterned photoresist layer 310 comprises openings 310*a* exposing a portion of the copper layer 302. For example, each of the openings 310*a* has a width of about 210 micrometers and a depth of about 50 micrometers.

Figure 3:
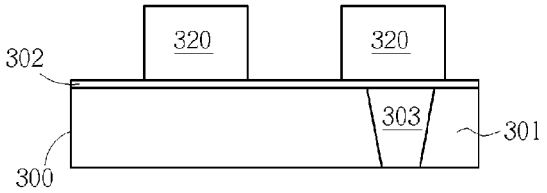

As shown in FIG. 3, an electroplating process is carried out to fill the openings 310*a* with plated copper, thereby forming first conductive traces 320 having a width of about 210 micrometers and a thickness of about 46 micrometers. Subsequently, the patterned photoresist layer 310 is stripped off. The first conductive traces 320 may have a spiral shape or pattern that is similar to layers as depicted in FIG. 1. It is noteworthy that each of the first conductive traces 320 has a vertical sidewall profile.

Figure 4:
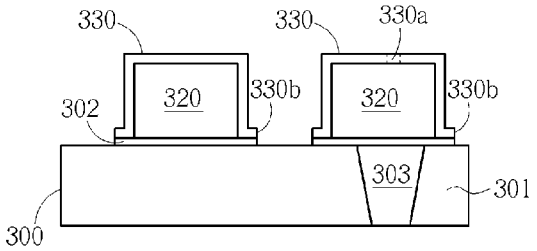

As shown in FIG. 4, after forming the first conductive traces 320, the copper layer 302 between first conductive traces 320 is removed. Subsequently, a dielectric layer 330 is provided to conformally cover the first conductive traces 320. A via hole 330*a* is formed in the dielectric layer 330 to expose a portion of the top surface of each of the first conductive traces 320. An opening 330*b* may be provided in the dielectric layer 330 between the first conductive traces 320.

Figure 5:
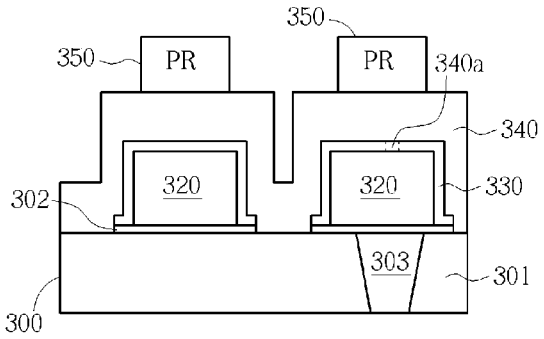

As shown in FIG. 5, an electroplating process may be carried out to form a copper layer 340 over the substrate 300. A copper seed layer (not shown) may be formed using sputtering methods prior to the formation of the copper layer 340. The copper layer 34 may fill the via hole 330*a* to form a via 340*a*. The dashed line of the via 340*a* indicates that the via 340*a* is not coplanar with the cross-section shown in this figure. Further, the copper layer 340 may fill the opening 330*b*. A patterned photoresist layer 350 is then formed on the copper layer 340 for defining the pattern of the second layer of a coil portion of the electromagnetic component.

Figure 6:
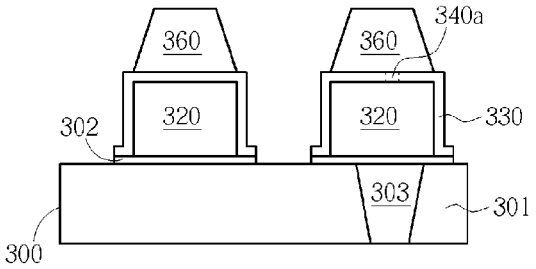

As shown in FIG. 6, the copper layer 340 that is not covered by the patterned photoresist layer 350 is etched away using, for example, wet etching methods, thereby forming second conductive traces 360 stacked on respective first conductive traces 320. The second conductive traces 360 may have a spiral shape or pattern that is similar to layers as depicted in FIG. 1 and are electrically connected to the underlying first conductive traces 320 through the via 340*a*. The second conductive traces 360 may have a tapered sidewall profile.

Figure 7:
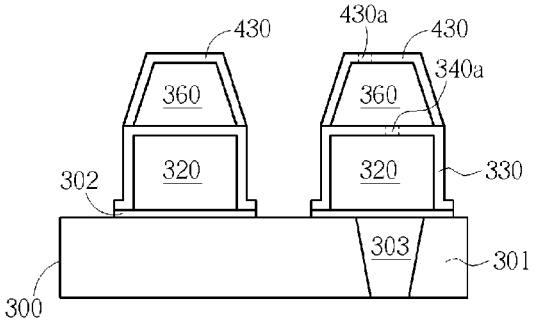
Figure 8:
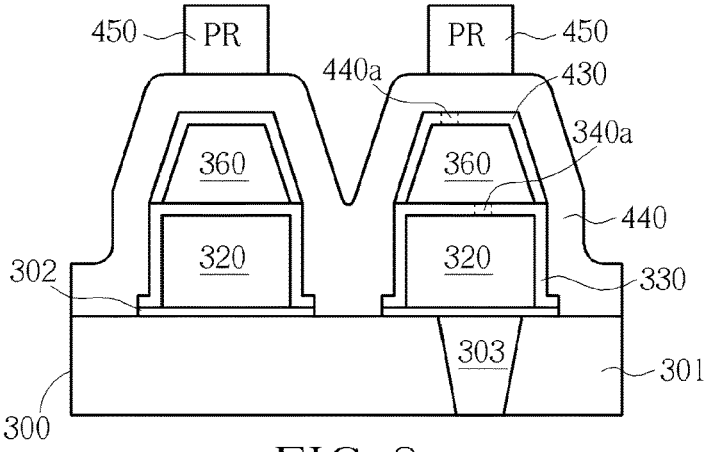
Figure 9:
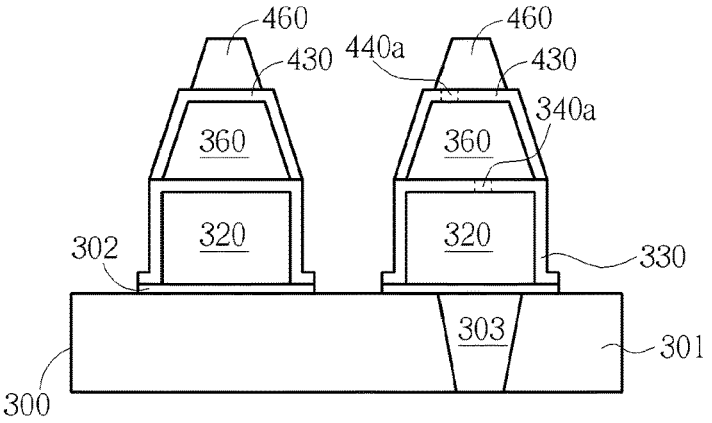
Figure 10:
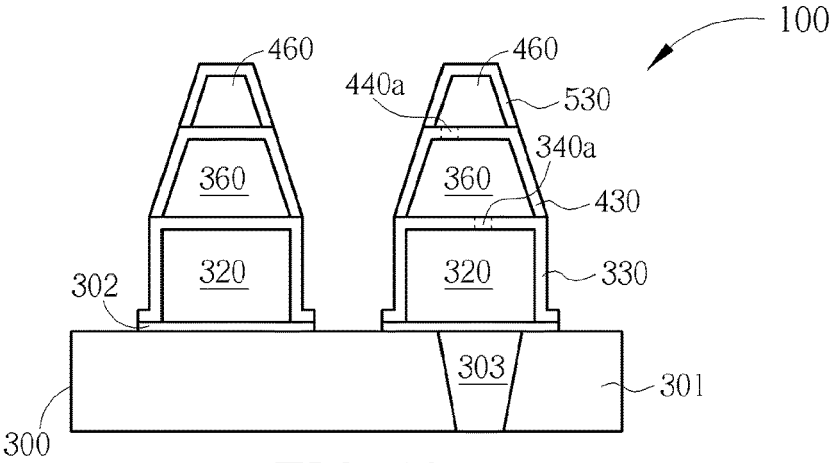

As shown in FIGS. 7-9, similar process steps as depicted through FIG. 4 to FIG. 6 are repeated to form a dielectric layer 430 with a via hole 430*a* therein on the second conductive traces 360 (FIG. 7), a copper layer 440 plated on the substrate 300 in a blanket manner, via 440*a* in the via holes 430*a*, a patterned photoresist layer 450 on the copper layer 440 (FIG. 8), and third conductive traces 460 (FIG. 9). Likewise, the third conductive traces 460 may have a shape or pattern that is similar to layers as depicted in FIG. 1 and are electrically connected to the underlying second conductive traces 360 through the via 440*a*. As shown in FIG. 10, a dielectric layer 530 is provided to conformally cover the third conductive traces 460 to thereby complete the coil stack structure 100 on one side of the substrate 300. As previously mentioned, the same coil stack structure may be fabricated using the above-described steps on the other side of the substrate 300.

Figure 11A:
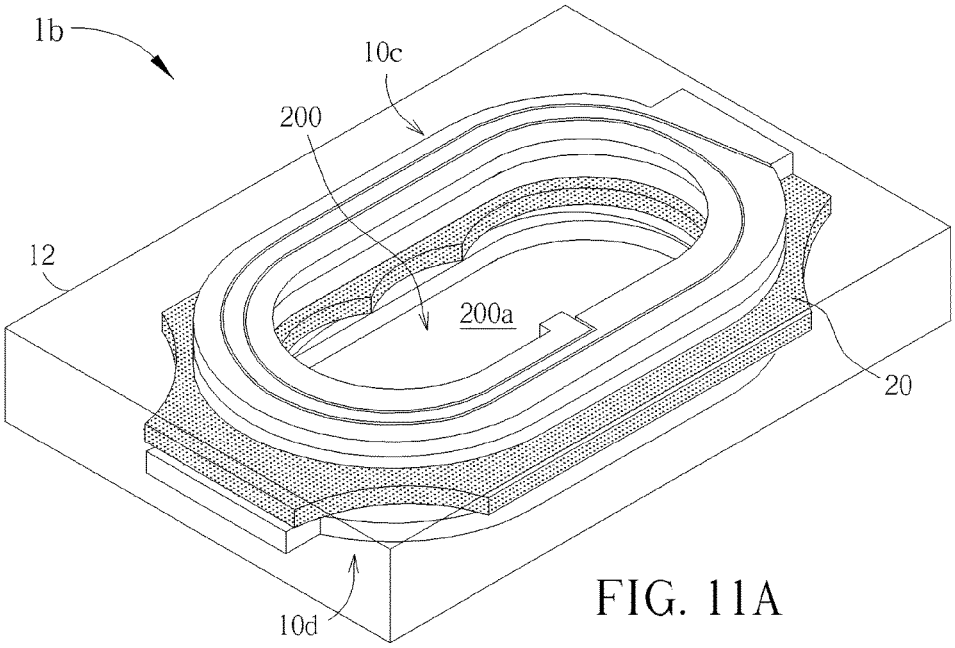
FIG. 11A is a schematic, perspective view showing an exemplary coil structure of an electromagnetic component in accordance with another embodiment of this invention.
Figure 11B:
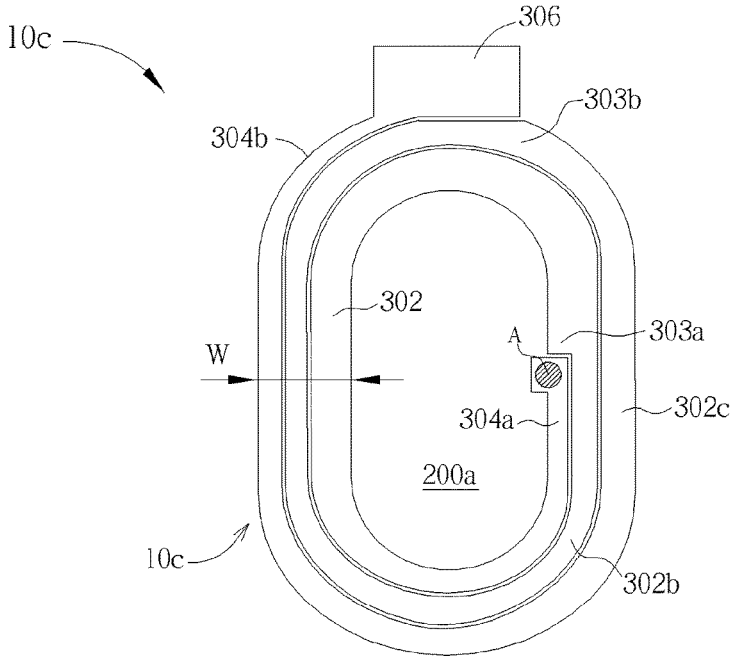
FIG. 11B is a top view of the coil structure.

FIG. 11A is a schematic, perspective view showing a spiral coil structure of an electromagnetic component in accordance with another embodiment of this invention. FIG. 11B is a top view of the spiral coil structure in FIG. 11A. As shown in FIG. 11A, the electromagnetic component 1*b* comprises a spiral coil structure 10*c* situated on one side of a substrate 20. The substrate 20 may be an insulating substrate, but not limited thereto. The coil structure 10*c* may have a multi-layered conductor film stack structure with intervening insulating layers. On the opposite side of the substrate 20, a coil structure 10*d*, which may be a multi-layer conductor film stack similar to the coil structure 10*a*, may be provided. The coil structures 10*c*, 10*d* and the substrate 20 are encapsulated by a molded body 12 comprising thermosetting resins and metallic powder such as ferrite powder. The molded body 12 fills into the central opening 200 to form a central pillar 200*a*.

According to this embodiment, the coil winding of each of the coil structures 10*c*, 10*d* may be spirally wound in the same horizontal plane with multiple turns around the central pillar 200*a*. As shown in FIG. 11B, for example, the three turns of the single, spiral coil winding of the coil structure 10*c* may begin, in an inner turn, at an inner terminal A that is located at a tip portion of the distal, slim end segments 304*a*, and may end at the terminal 306. An SMD electrode (not shown) may be provided to electrically connect the terminal 306. From the terminal A, the coil structure 10*c* may be electrically connected to a lower level coil structure through a via within the electromagnetic component 1*b*.

The spiral coil winding of the coil structure 10*c* may have multiple segments including but not limited to two distal, slim end segments 304*a* and 304*b*, intermediate segments 302 with a uniform width, and tapered segments 303*a* and 303*b*. In order to efficiently utilize the space, the tapered segment 303*a* may have an abrupt edge and an outline that conforms to the outline of the inner terminal A, such that the tapered segment 303*a* at least partially encompasses the two adjacent sides of the terminal A. Compared to the tapered segment 303*a*, the tapered segment 303*b* does not have abrupt edges. As shown in FIG. 11B, the tapered segment 303*a* connects two intermediate segments 302*a* and 302*b* with a uniform width. The tapered segment 303*b* connects two intermediate segments 302*b* and 302*c* with a uniform width. The two distal, slim end segments 304*a* and 304*b*, intermediate segments 302 with uniform width, tapered segments 303*a* and 303*b*, and the spacing therebetween together define an annular coil pattern with a uniform width W around the central pillar 200*a*.

Figure 12:
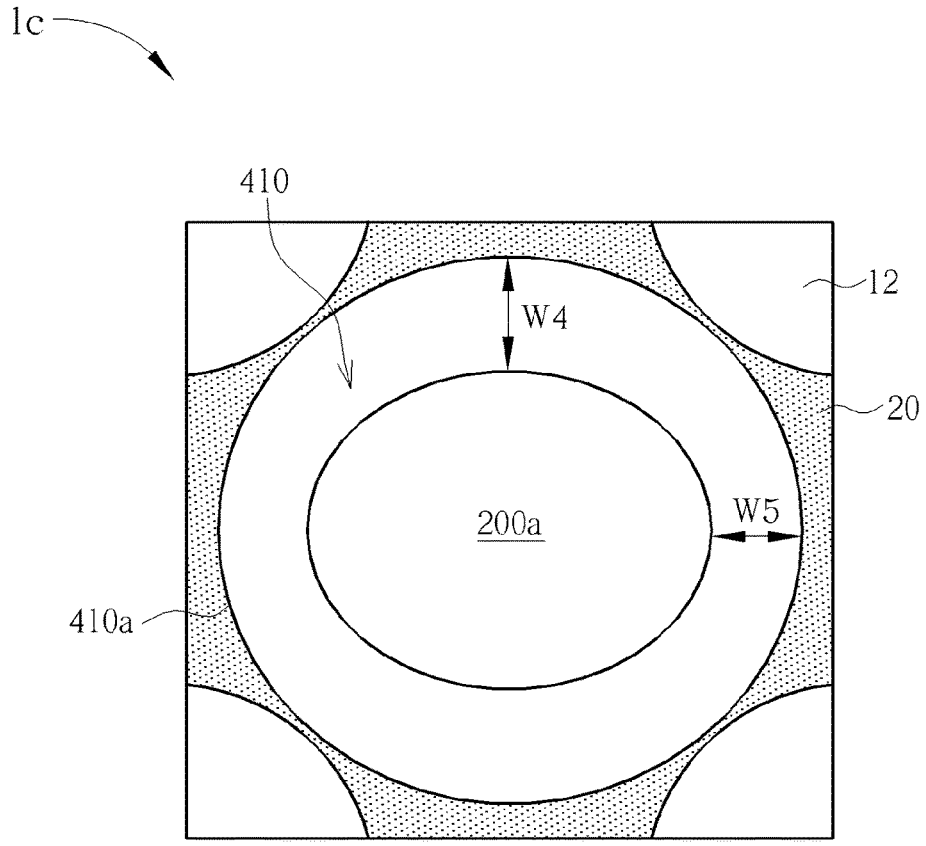
FIG. 12 is an exemplary top view of an electromagnetic component showing that an annular coil pattern has a circular outline and encompasses a pillar having an oval outline.

However, it is to be understood that the annular coil pattern around the central pillar 200*a* may have various thicknesses or dimensions in other embodiments. For example, as shown in FIG. 12, an exemplary top view of an electromagnetic component 1*c* shows that the annular coil pattern 410 has a circular outline 410*a* and encompasses a central pillar 200*a* having an oval outline, and vice versa. In this way, the annular coil pattern 410 has a wider opposite portions with a width w4 and narrower opposite portions with a width w5. However, it is to be understood that the relationship between w4 and w5 may vary depending upon the design requirements. The annular coil pattern 410 may have a coil winding that is wound as described in FIG. 1, FIG. 1A or FIGS. 11A-11B, which is not expressly shown in FIG. 12.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electromagnetic component, comprising:

a conductive structure, comprising at least one conductive layer to form a coil, wherein a conductive layer comprises a coil pattern comprising a middle trace comprising a contiguous portion extending from a first side of the conductive layer to a second side opposite to the first side of the conductive layer, a first slim trace and a second slim trace, wherein the first slim trace comprises a first end point of the coil pattern and the second slim trace comprises a second end point of the coil pattern, and each of an inner side surface of the middle trace on the first side of the conductive layer and an inner side surface of the first slim trace on the second side of the conductive layer respectively forms a corresponding part of the innermost boundary of the coil pattern, wherein the width of the middle trace is respectively greater than that of the first slim trace and the second slim trace, wherein along the winding direction of the coil pattern, the total length of the middle trace is respectively greater than that of the first slim trace comprising said first end point of the coil pattern and the second slim trace comprising said second end point of the coil pattern, wherein a portion of an outer side surface of the first slim trace and a portion of an inner side surface of the second slim trace are placed side by side on the second side of the conductive layer for matching the width of the middle trace with a total of the width of the first slim trace, the width of the second slim trace and a spacing between said two slim traces.

2. The electromagnetic component according to claim 1, wherein the conductive layer further comprises a first transition trace, wherein the width of the first transition trace is gradually reduced to connect the middle trace to the first slim trace.

3. The electromagnetic component according to claim 2, wherein the width of the first transition trace is gradually reduced only in an inner side of the first transition trace to connect the middle trace to the first slim trace.

4. The electromagnetic component according to claim 2, wherein the conductive layer further comprises a second transition trace, wherein the width of the second transition trace is gradually reduced to connect the middle trace to the second slim trace.

5. The electromagnetic component according to claim 1, wherein the width of the middle trace is substantially equal to the total of the width of the first slim trace, the width of the second slim trace and the spacing between said two slim traces.

6. The electromagnetic component according to claim 1, the width of middle trace is about 210 micrometers, each of the width of the first slim trace and the width of the second slim trace is respectively less than or equal to 100 micrometers and the spacing between the first slim trace and the second slim trace is about 5-30 micrometers.

7. The electromagnetic component according to claim 1, the width of middle trace is about 210 micrometers, each of the width of the first slim trace and the width of the second slim trace is respectively less than or equal to 100 micrometers and the spacing between the first slim trace and the second slim trace is about 5-10 micrometers.

8. The electromagnetic component according to claim 1, wherein the conductive structure is on a substrate, wherein a molding body encapsulates the substrate and the conductive structure, wherein the molded body is extended into an opening of the substrate to form a pillar, wherein the coil is wound around the pillar.

9. The electromagnetic component according to claim 8, wherein the substrate comprises serrations around a perimeter of the opening.

10. The electromagnetic component according to claim 1, wherein a first portion of the conductive structure is on a top surface of the substrate and a second portion of the conductive structure is on a bottom surface of the substrate, wherein a molding body encapsulates the substrate and the conductive structure, wherein the molding body is extended into an opening of the substrate to form a pillar, wherein the coil is wound around the pillar.

11. The electromagnetic component according to claim 1, wherein a first electrode is electrically connected to said first end point of the first slim trace and a second electrode is electrically connected to said second end point of the second slim trace.

12. An electromagnetic component, comprising:

a conductive structure, comprising at least one conductive layer to form a coil, wherein a conductive layer comprises a coil pattern comprising a middle trace comprising a contiguous portion extending from a first side of the conductive layer to a second side opposite to the first side of the conductive layer, a first transition trace, a second transition trace, a first slim trace and a second slim trace, wherein the first slim trace comprises a first end point of the coil pattern and the second slim trace comprises a second end point of the coil pattern, and each of an inner side surface of the middle trace on the first side of the conductive layer and an inner side surface of the first slim trace on the second side of the conductive layer respectively forms a corresponding part of the innermost boundary of the coil pattern, wherein the width of the middle trace is respectively greater than that of the first slim trace and the second slim trace, wherein along the winding direction of the coil pattern, the total length of the middle trace is respectively greater than that of the first slim trace comprising said first end point of the coil pattern and the second slim trace comprising said second end point of the coil pattern, wherein a portion of an outer side surface of the first slim trace and a portion of an inner side surface of the second slim trace are placed side by side on the second side of the conductive layer, wherein the width of the first transition trace is gradually reduced to connect the middle trace to the first slim trace, and the width of the second transition trace is gradually reduced to connect the middle trace to the second slim trace.

13. The electromagnetic component according to claim 12, wherein a portion of an outer side surface of the first slim trace and a portion of an inner side surface of the second slim trace are placed side by side such that the width of the middle trace is substantially equal to the total of the width of the first slim trace, the width of the second slim trace and a spacing between the two slim trace.

14. The electromagnetic component according to claim 13, wherein a first electrode is electrically connected to said first end point of the first slim trace and a second electrode is electrically connected to said second end point of the second slim trace.

15. The electromagnetic component according to claim 12, the width of middle trace is about 210 micrometers, each of the width of the first slim trace and the width of the second slim trace is respectively less than or equal to 100 micrometers, and the spacing between the first slim trace and the second slim trace is about 5-30 micrometers.

16. The electromagnetic component according to claim 12, the width of middle trace is about 210 micrometers, each of the width of the first slim trace and the width of the second slim trace is respectively less than or equal to 100 micrometers, and the spacing between the first slim trace and the second slim trace is about 5-10 micrometers.

17. The electromagnetic component according to claim 12, wherein the conductive structure is disposed on a substrate, wherein a molding body encapsulates the substrate and the conductive structure, wherein an opening is formed inside the coil and penetrating through the substrate; and the magnetic molding body encapsulates the conductive structure and extends into the opening to form a pillar for the coil.

18. The electromagnetic component according to claim 17, wherein a first portion of the magnetic molding body disposed inside the opening is in contact with a portion of the coil on the at least one conductive layer.

* * * * *